US005392676A

United States Patent [19]

Drury

[11] Patent Number: 5,392,676

[45] Date of Patent: Feb. 28, 1995

[54] WALLPAPER TRIMMER

[76] Inventor: Donald R. Drury, 963 Hackmann Rd., St. Paul, Mo. 63366

[21] Appl. No.: 54,424

[22] Filed: Aug. 9, 1993

[51] Int. Cl.[6] ..... B26D 7/02; B65H 35/06

[52] U.S. Cl. ..... 83/455; 83/614; 83/649; 242/598; 269/91

[58] Field of Search ..... 83/649, 455, 614, 650, 83/821; 225/27, 82, 86, 87, 42; 242/55.2, 55.3, 56.6, 598.1, 598; 30/296.1, 286, 289, 292; 269/91, 94, 97

[56] References Cited

U.S. PATENT DOCUMENTS

| | | | |
|---|---|---|---|
| 1,721,200 | 7/1929 | Beardsley | 242/55.2 |
| 2,609,047 | 9/1952 | Wilkoff | 83/649 X |
| 3,142,217 | 7/1964 | Busse | 83/614 X |
| 3,358,540 | 12/1967 | Hall | 83/649 X |
| 3,430,877 | 3/1969 | Berlet | 242/55.2 |
| 3,659,487 | 5/1972 | Henderson | 83/649 X |
| 3,752,025 | 8/1973 | Van Everdingen | 83/649 X |
| 3,788,175 | 1/1974 | Davis | 83/649 X |
| 4,022,393 | 5/1977 | Curcio | 242/55.2 |
| 4,344,551 | 8/1982 | Albin | 83/649 X |
| 5,103,710 | 4/1992 | Ross | 83/649 X |
| 5,121,885 | 6/1992 | Chipman | 83/649 X |

FOREIGN PATENT DOCUMENTS

| | | | |
|---|---|---|---|
| 0338648 | 10/1989 | European Pat. Off. | 83/649 |
| 2446574 | 4/1975 | Germany | 83/649 |
| 2758563 | 7/1979 | Germany | 83/649 |
| 506380 | 4/1971 | Switzerland | 83/649 |
| 2190897 | 12/1987 | United Kingdom | 83/649 |

*Primary Examiner*—Rinaldi I. Rada
*Assistant Examiner*—Clark F. Dexter
*Attorney, Agent, or Firm*—Polster, Lieder, Woodruff & Lucchesi

[57] ABSTRACT

A device for trimming wallpaper, including champs for fastening the device to a flat surface, a rod for holding a roll of wallpaper, an adjustable stop to accommodate rolls of different widths, and a retainer to hold the wallpaper on a cutting surface adjacent to a slot in the cutting surface which accommodates a knife edge to allow the wallpaper to be severed from the roll with a straight edge.

8 Claims, 2 Drawing Sheets

WALLPAPER TRIMMER

BACKGROUND OF THE INVENTION

The invention relates to the field of trimming wallpaper and specifically relates to a device which holds a roll of wallpaper and provides a straight edge slot which can accommodate a knife edge blade which is used to sever a section of paper from the roll with a smooth edge cut at right angles to the side edges of the wallpaper.

The conventional method of trimming wallpaper to size is by the use of a pair of scissors, but this makes it difficult for an amateur to make a straight smooth cut.

Accordingly, it is a principal object of the present invention to provide a device which can be used to provide a straight edge cut on a piece of wallpaper.

It is another object to provide a device which can be readily attached to a table or a saw horse set up, and which can be used to sever a section of wallpaper from a roll with a straight edge.

Still another object of the present invention is to provide a device which is adapted to hold wallpaper rolls of different widths and still provide a surface on which a straight cut can be made across the wallpaper.

A further object is to provide a wallpaper dispenser which has a pivotable retainer which can be rotated into wallpaper retaining position adjacent to a slot which acts as a straight edge for a knife edge cutter to sever a section of wallpaper from a roll with a straight cut.

These and other objects and advantages will become apparent hereinafter.

SUMMARY OF THE INVENTION

The invention comprises a device for cutting wallpaper or the like comprising a clamp for attaching the device to a supporting surface, a support for holding a roll of wallpaper, an adjustable lock for positioning wallpaper rolls of different widths on said support, a cutting table above the top of the supporting surface associated with the wallpaper roll support, and a pivotable retainer for movement between an open position in which the wallpaper can be passed over the cutting table and a closed position in which said retainer engages the top surface of the wallpaper and retains the wallpaper in position to be cut.

DESCRIPTION OF THE DRAWINGS

In the accompanying drawings which form part of the specification and wherein like numerals and letters refer to like parts wherever they occur.

DETAILED DESCRIPTION

Figure 1:
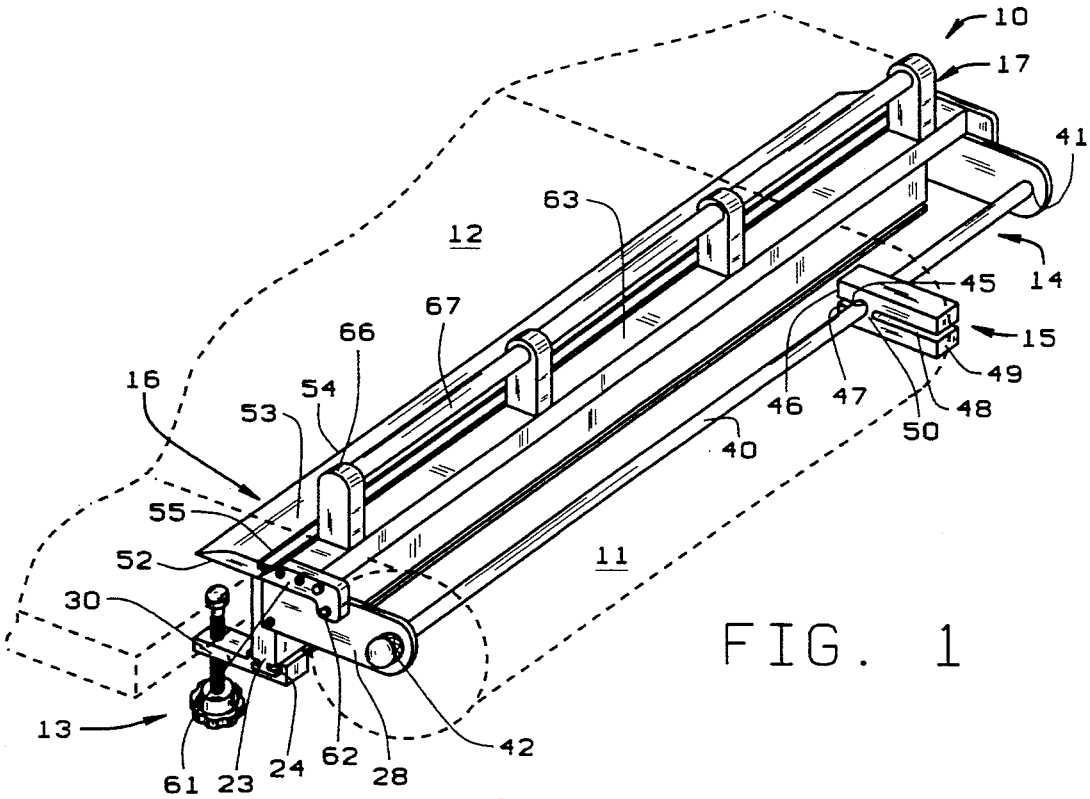
FIG. 1 is a perspective view of the present invention showing a roll of wallpaper in phantom lines and a table top to which the invention is attached in phantom lines.
Figure 2:
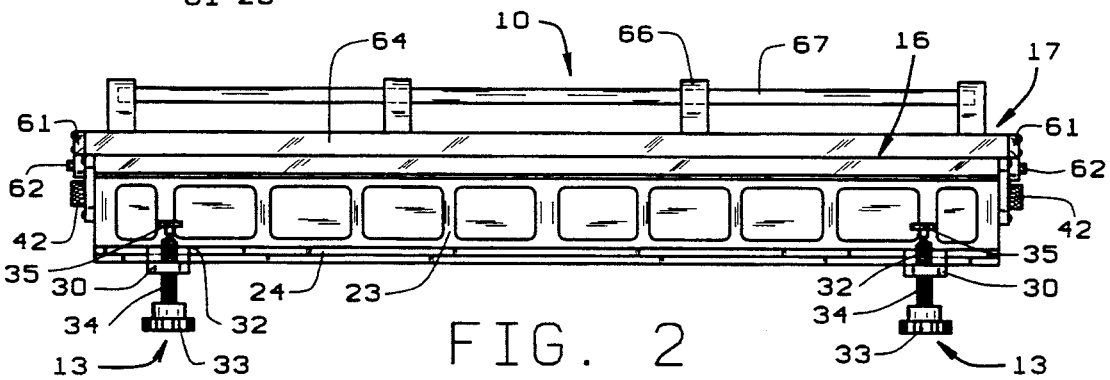
FIG. 2 is a front elevational view of the device shown in FIG. 1.
Figure 3:
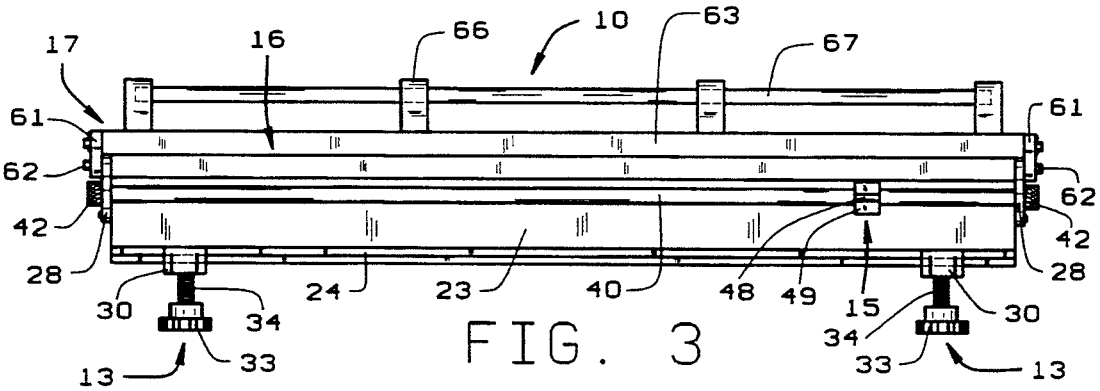
FIG. 3 is a rear elevational view of the device shown in FIG. 1.
Figure 4:
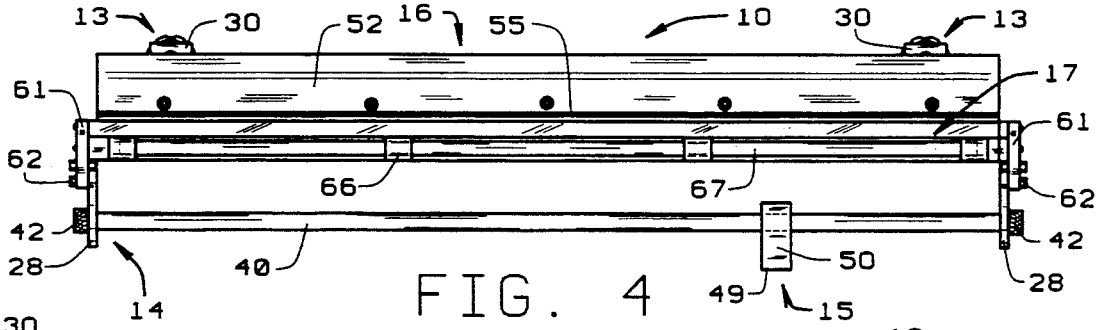
FIG. 4 is a top plan view of the device shown in FIG. 1.
Figure 5:
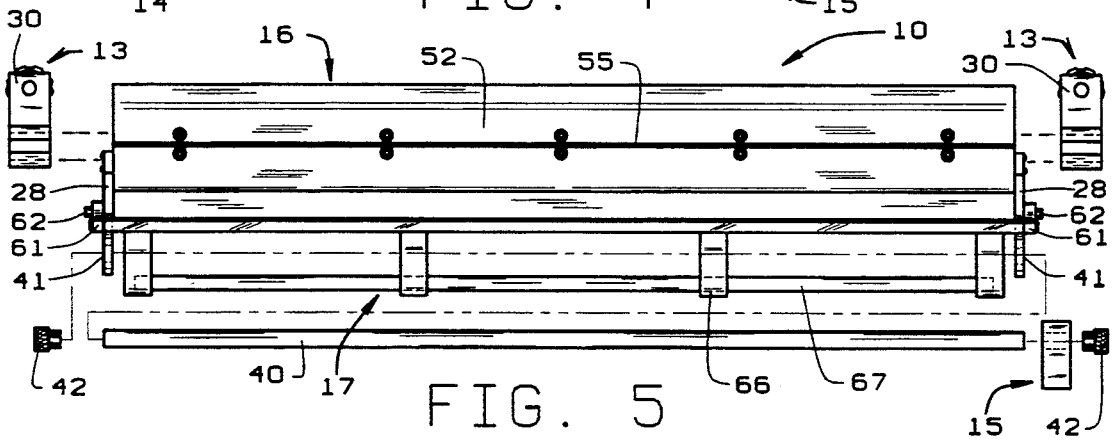
FIG. 5 is an exploded plan view of the device with the clamp in open position.
Figure 6:
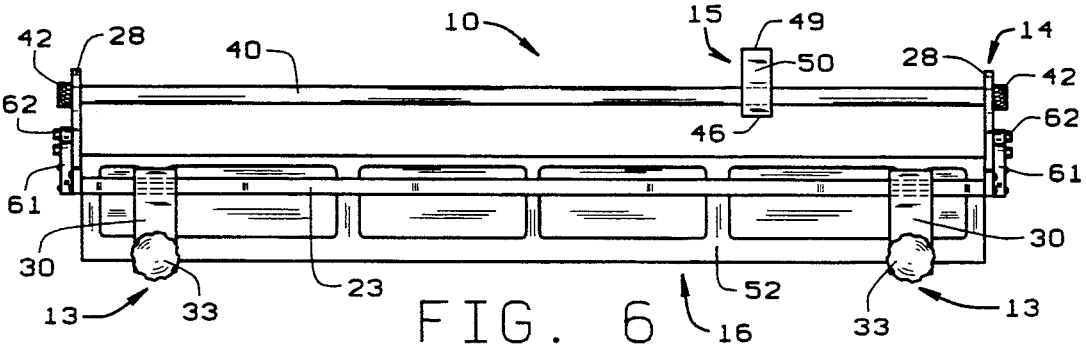
FIG. 6 is a bottom view of the device shown in FIG. 1.

The present invention comprises a device 10 for cutting wallpaper (shown in FIG. 1 in broken lines as wallpaper roll 11), which device 10 can be fastened to a supporting surface 12 (also shown in broken lines in FIGS. 1, 7, 8 and 9), such as, a table, a stand supported on saw horses, or the like. The wallpaper cutter 10 includes a pair of clamp means 13 for attaching the device to the support 12, a support 14 for holding the roll of wallpaper 11, an adjustable stop 15 for positioning wallpaper rolls of different widths on the support 14, a cutting table 16, which also acts in conjunction with the clamp 13 for retaining the device 10 to the support 12, and a pivotable retainer means 17, which is movable between an open position (shown in FIG. 8) in which the wallpaper 11 can be passed over the cutting table 16, and a closed position (shown in FIGS. 1, 7 and 9) in which said retainer 17 engages the top surface of the wallpaper 11 on the cutting table 16 and retains the wallpaper 11 in position to be cut.

The wallpaper cutting device 10 also includes a main longitudinal depending leg or body block 23 which depends downwardly at right angles to the cutting table 16 and has a double sided slot 24, adjacent to, but spaced upwardly from its lowermost edge, in which slot 24 the clamp means 13 are slidably retained. At the ends of the main body block 23 are cantilevered bracket arms or flanges 28 in which the ends of the wallpaper roll support 14 are removably positioned adjacent to the free ends of the arms 28. The pivotable retainer means 17 is rotatably attached to the arms 28 at points 62 which are between the areas of attachment to the body block 23 and where the roll support 14 is attached to the arms 28.

Figure 7:
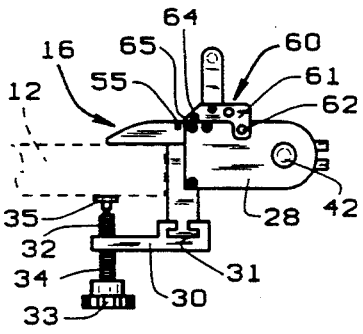
FIG. 7 is a left end elevational view with the clamp closed and a table top in phantom lines.
Figure 8:
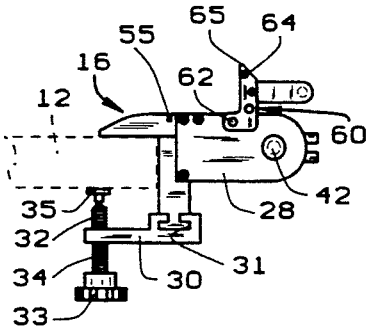
FIG. 8 is a left end elevational view with the clamp closed and showing a table top in phantom lines.
Figure 9:
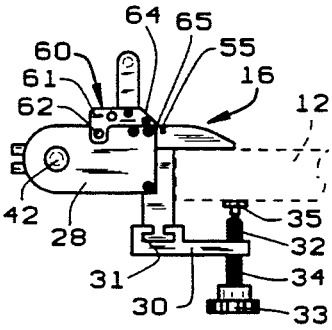
FIG. 9 is a right end elevational view with the clamp open and showing a table top in phantom lines.

The clamp means 13 includes a support 30 which is provided with a "T-shaped" channel 31 at one end and a threaded movable retaining member 32 at the other end, as best shown in FIGS. 7–9. The threaded clamp retainer 32 includes a handle means 33, a threaded stem 34 and a foot 35 which is adapted to engage the underside of the table 12. There is one clamp 13 at each end of the main body block 23. The clamp channels 31 slidingly engage the main body slot 24 so that the clamps 13 are slidable along the main body block 23 and allow the device 10 to be positioned on support surfaces 12 of different lengths.

The wallpaper roll support 14 includes a rod 40 which is removably positioned in openings 41 in the free ends of the arms 28. The rod 40 is held in the arms 28 by means of removable end caps 42 which fasten onto the ends of the rod 40. To position a wallpaper roll 11 on the rod 40, one of the end caps 42 is removed, the rod is removed from the opening 41, and the wallpaper roll 11 is slipped onto the rod 40. The rod 40 then is repositioned in the arm opening 41 and the end cap 42 is replaced.

The adjustable stop 15 is made of a flexible material, such as plastic, and is provided with an arcuate opening 45 adjacent to one end 46. The opening 45 is connected to the edge 46 by an opened ended slot 47. A slot 48 in the other end 49 of the stop 15 allows the stop 15 to be flexed, with the solid area 50 between the opening 45 and the elongated slot 48 acting as a fulcrum, to loosen the grip of the arcuate opening 45 on the rod 40 and allow the stop 15 to be slid along the length of the rod 40 to accommodate wallpaper rolls 11 of different widths. The stop 15 with the slots 47 and 48 acts somewhat like a clothes line clip. In other words, when the clamp ends 49 adjacent to the slot 48 are flexed together, the slot 47 is opened up, and the arcuate opening 45 expands, to allow the stop 15 to be moved along the rod 40. When the pressure on the clamp ends 49 adjacent to the slot 48 is released, the arcuate opening 45 regains its grip on the rod 40 and accurately positions the wallpaper roll 11 in a fixed position with respect to the rod 40.

The cutting table 16 comprises a flat under surface 52 and a top surface 53 which tapers to a front edge 54. A slot 55 runs longitudinally along the width of the cutting table 16 in its top surface 53, and has the function of defining a straight line and is used with a knife edge cutter (not shown) to cut a straight line on the unrolled wallpaper 11.

The pivotable retainer 17 includes a pair of right angular or L-shaped end brackets 61 which are pivotably mounted at 62 to the depending arms 28, and a rectangular member 63 connected between the end brackets 61 and terminating in a tapered surface 64 which defines a front edge 65 spaced slightly rearwardly from the slot 55 in the cutting table 16. The edge 65 acts as a guide for the knife edge which is inserted into the slot 55 to cut the wallpaper 11 in a straight line.

The retainer 17 also includes upstanding supports 66 which are positioned along the length of the member 63 and retain a handle 67 which is used to pivot the clamp 17 between an open position, in which the wallpaper 11 can be freely moved from the roll onto the table 12, and a closed position (shown in FIGS. 7 and 9), where the retainer 17 holds the wallpaper 11 in position on the table 12.

This invention is intended to cover all changes and modifications of the example of the invention herein chosen for purposes of the disclosure which do not constitute departures from the spirit and scope of the invention.

What is claimed is:

1. A device for holding wallpaper while it is cut and which is attachable to a support which has a top and bottom surface comprising:

(a) clamp means including a set of clamp retainers which are movable to vary the distance between said clamp retainers said clamp retainers being engageable with the bottom surface of said support, (b) a wallpaper roll support means for holding a roll of wallpaper, (1) body block means connecting the wallpaper roll support means to the clamp means, (c) a cutting table for engaging the top of said support aligned with the wallpaper roll support, said cutting table cooperating with the clamp retainers to fasten the device to said support, said cutting table having a top surface and a slot in the top surface for accepting an edge of a cutter to define a straight edge cut for the wallpaper, (1) said body block means further connecting the cutting table to the clamp means, and (d) a pivotable retainer means movable between an open position in which the wallpaper is passed over the cutting table and a closed position in which said retainer engages a top surface of the wallpaper adjacent to the cutting table slot and retains the wallpaper against the top surface of the cutting table in position to be cut.

2. The device of claim 1 including an adjustable stop on the wallpaper roll support means for positioning wallpaper rolls of different widths on said support.

3. The device of claim 2 wherein the adjustable stop is movable along the wallpaper roll support means and is selectively and releasably fixed in position along said wallpaper roll support means.

4. The device of claim 1 including a handle on the pivotable retainer to facilitate moving the retainer into and out of engagement with the wallpaper.

5. The device of claim 1 wherein the wallpaper roll support means is a rod having ends rotatably positioned in bracket arms which support the retainer.

6. The device of claim 5 wherein the rod is removably positioned in the bracket arms so that the rod can be removed from at least one of the bracket arms and threaded through a roll of wallpaper.

7. The device of claim 5 including removable caps on at least one end of the rod outside of the bracket arms.

8. A device for holding wallpaper while it is cut and which is attachable to a flat surface which has a top and bottom comprising:

(a) an elongated body member attachable to the flat surface, said body member including (1) a longitudinal wall paper supporting surface designed to lie on the top of said flat surface, (2) a longitudinal body block supporting said wall paper supporting surface and designed to pass along an edge of said flat surface past the underside thereof, (3) a pair of bracket arms at the ends of the body block and extending in a direction opposite the wallpaper supporting surface, (4) said body block having opposed longitudinal channels on the sides thereof, (5) the wallpaper supporting surface having a longitudinal slot along its length for accommodating a wallpaper cutter, (6) the bracket arms having opposed openings therein, (b) a rod removably positioned in the bracket arm openings, (1) the rod holding a roll of wallpaper, and (2) releasable caps on the ends of the rod for holding the rod in the bracket arm openings and allowing removal of the rod therefrom, whereby wallpaper rolls can be loaded and removed from the rod, (c) a stop positioned on the rod and movable along the rod to retain wallpaper rolls of different widths on the rod, (d) a pivotable retainer pivotably mounted on said bracket arms and movable into and out of engagement with the wallpaper supporting surface to hold the wallpaper during cutting, (1) an upstanding handle on the retainer to facilitate pivoting of the retainer, (2) a straight edge on the retainer aligned with the slot in the wallpaper supporting surface, and (e) clamp retainers on the body block and movable along the channels therein to position and retain the wallpaper cutter on the flat surface.

* * * * *